United States Patent [19]

Prillieux et al.

[11] 4,078,010

[45] Mar. 7, 1978

[54] HYDROGENATED OLEFINE OLIGOMERS

[75] Inventors: Marcel Prillieux; Marcel Robert; Robert Tirtiaux, all of Mont-Saint-Aignan, France

[73] Assignee: Exxon Research & Engineering Co., Linden, N.J.

[21] Appl. No.: 595,057

[22] Filed: Jul. 11, 1975

[30] Foreign Application Priority Data

Jul. 17, 1974 France .....74.24784

[51] Int. Cl.[2] ..... C07C 3/18; C07C 11/00

[52] U.S. Cl. ..... 260/676 R; 252/59; 252/73; 260/683.15 A; 260/683.15 B; 260/683.9

[58] Field of Search ..... 260/683.15 A, 683.15 B, 260/676 R; 208/19; 252/59, 73

[56] References Cited

U.S. PATENT DOCUMENTS

| | | | |
|---|---|---|---|
| 2,957,930 | 10/1960 | Jackson | 260/683.15 B |
| 3,283,029 | 11/1966 | Brilland et al. | 252/73 |
| 3,285,851 | 11/1966 | Dyer | 252/32.5 |
| 3,595,796 | 7/1971 | Duling et al. | 252/73 |
| 3,608,385 | 9/1971 | Duling et al. | 252/73 |
| 3,691,078 | 9/1972 | Johnston et al. | 252/73 |
| 3,843,537 | 10/1974 | Duling et al. | 252/73 |

FOREIGN PATENT DOCUMENTS

| | | |
|---|---|---|
| 1,148,966 | 4/1969 | United Kingdom. |

*Primary Examiner*—C. Davis
*Attorney, Agent, or Firm*—Frank T. Johmann

[57] ABSTRACT

Oligomerizing propylene using a Friedel Crafts catalyst at a temperature in the range −10° to 80° C and hydrogenating the oligomer so obtained to produce oils useful as hydraulic fluids.

9 Claims, No Drawings

HYDROGENATED OLEFINE OLIGOMERS

The invention is concerned with the production of paraffinic base oils especially those that are used in hydraulic systems with mechanical transmission, in hydraulic shock-absorbers etc.

For a liquid to be useful as a hydraulic fluid it must have a fairly high boiling point, as low a freezing point as possible, a high viscosity index and good lubricating properties. The sealing joints, in hydraulic transmission systems are usually made with elastomers so it is important that the fluid be practically inert in relation to the particular elastomers with which it is brought into contact. In particular the fluid must not affect the mechanical properties of these materials nor must it cause excessive swelling or contraction of the elastomer.

Use is sometimes made of fluids based on glycols or glycol polyethers, but these products are costly and their hydrophilic nature is troublesome in certain applications.

It is also known to use both mineral and synthetic hydrocarbon oils. However, hydrocarbon oils must have a low freezing point and a flash point exceeding 100° C in open vessel. In addition the viscosity must be strictly adapted to the particular use for which the fluid is intended and since the range of viscosities of hydrocarbon bases for the usual hydraulic fluids extends from 2 to 30 cSt at 37.8° C it is difficult to make, by refining crude petroleum distillates, oils that are suitable as bases for hydraulic fluids. It is only at the cost of very intensive refining that a mineral oil is obtained having sufficient inertia and a sufficiently low freezing point in relation to the elastomers.

It has also been known for some time that the oils obtained by polymerisation of light olefins can be used as bases for hydraulic fluids. The properties of these synthetic oils, in particular their resistance to oxidation, are further improved by subjecting them to hydrogenation (R.E. Hatton "Introduction to Hydraulic Fluids" 1962, pages 181 and 182). In addition there are many patents relating to the manufacture or uses of oils of this type.

For example French Pat. No. 794,397 mentioned as long ago as 1935 the possibility of manufacturing lubricating oils by the polymerisation of light olefins, such as propylene and isobutylene, and the hydrogenation of the polymer obtained. U.S. Pat. No. 2,360,446 proposes the use, for lubricating internal combustion engines, of a composition containing an oil of this type. The oils discussed have a viscosity exceeding 15.5 cSt at 99.9° C. This patent mentions that this oil can be made from propylene or isobutylene, by means of polymerisation in the presence of a Friedel Crafts catalyst followed by hydrogenation of the polymer. However, the viscosity of these synthetic oils is very variable and fractional distillation has to be carried out to obtain the fraction having the desired flash point and viscosity and the yield is often poor. Furthermore these synthetic oils consist of isoparaffinic hydrocarbons whose degree of branching and purity are variable which makes it difficult to master their swelling properties in relation to elastomers.

French Pat. No. 1,357,634 proposes a basic oil for hydraulic fluids which gives every satisfaction, in particular as regards its effects on elastomers. The manufacture of this oil is associated with the manufacture of technical tripropylene and tetrapropylene, in which the oligomerisation of the propylene is carried out, at a temperature of at least 140° C, on a catalyst based on phosphoric acid, and the oligomers thus obtained subjected to fractional distillation. According to French Pat. No. 1,357,634 by hydrogenating a fraction of these oligomers, whose initial distilling point is in excess of 175° C, or a fraction distilling between 200° and 300° C, an oil is obtained which is perfectly suitable as a base for very high quality hydraulic fluids. However this process suffers from the disadvantage that the propylene oligomers that form at a temperature of at least 140° C and in contact with phosphoric acid, contain only a small proportion of the required fraction.

The need for high quality hydraulic fluids is constantly increasing while the need for tripropylene and tetrapropylene is static. We have therefore devised a process to obtain a suitable oil with a high yield which is not linked with the manufacture of tripropylene or tetrapropylene.

The polymerisation of propylene, isobutylene and n-butenes is regularly carried out in the liquid phase at temperatures of less than 100° C, and even much lower, in the presence of Friedel Crafts catalyst as is mentioned for example in U.K. Pat. No. 1,148,966. This patent also discloses that the mean molecular weight of the polymer obtained depends in particular on the reaction temperature and the activity of the catalyst. With the other factors unchanged, the mean molecular weight of a product is higher the lower the reaction temperature.

The present invention provides a process for the production of highly paraffinic basic oils having a flash point exceeding 100° C and the viscosity at 37.8° C within the range of 2 to 30 cSt comprising oligomerising an olefin selected from propylene, isobutylene, n-butenes and mixtures of these olefins in the liquid phase, in the presence of a Friedel Crafts catalyst at a temperature between −10° and 80° C, separating the catalyst and the oligomers thus formed and hydrogenating the oligomer or a fraction thereof.

It may be necessary to distil within the temperature range of −10° C to 80° C. The reaction temperature may be selected to ensure that an oligomer is obtained which on hydrogenation yields an oil of the required viscosity. Thus our process allows production of a desired oil in a high yield although we may distil the oligomer to isolate the fraction having the required viscosity and flash point. Even in this situation yields are high.

We have found that oligomerisation performed within the temperature range and with the type of catalyst specified above yields oligomers having the required mean molecular weight and viscosity for hydrogenating to produce basic oils for hydraulic fluids. Thus, following hydrogenation and fractionation if necessary it is possible to obtain the desired oil in high yield. The most favourable oligomerisation temperature to obtain a certain oil may be found by experimentation within the range specified.

Hydrogenation saturates the olefinic bond present in the molecules of the oligomer and is continued until the bromine number of the product is practically nil and in any case less than 1. Any conventional hydrogenation process may be used, the conditions of the reaction, in particular the temperature, being regulated so that no appreciable decomposition takes place. As a rule, practically no light products are formed if hydrogenation is performed at a temperature of less than 220° C. Our preferred method is to use a catalyst based on nickel, nickel and molybedenum, nickel and tungsten, nickel and cobalt, or a catalyst based on one or more of the oxides of these metals. The appropriate pressure and temperature depend on the activity of the catalyst used. For instance, hydrogenation can be performed with a catalyst based on nickel and cobalt, at a temperature from 180° to 220° C, at a pressure of 10 to 100 bars. The oil thus obtained consists of practically pure isoparaffinic hydrocarbons generally above 99% pure. Furthermore, we find that when the oil is made from propylene it has, in relation to elastomers, a particularly low swelling power.

Our preferred process for the oligomerisation of propylene is carried out as follows. A reactor provided with stirring and cooling means is used so that the reaction mixture may be maintained at the required temperature and the pressure is such that the mixture is liquid, a pressure of 30 bars in the reactor is generally sufficient. In the reactor, the propylene is brought into contact with 0.04 to 0.08% water and 0.5 to 0.8% anhydrous boron trifluoride. These proportions are expressed by weight in relation to that of propylene. The reaction temperature is generally one between 20° and 80° C and an average reaction time of half an hour is generally sufficient to accomplish the total conversion of the propylene.

The product of the reaction comprises gaseous products, mainly boron trifluoride and propane being the chief impurity of the propylene used as raw material; these gaseous products are separated by employing the usual appropriate means that are well known to the technician. After degassing, the oligomer contains boron and fluorine compounds derived from boron trifluoride which can be eliminated by washing the oligomer with a alkaline solution. The oligomer is then fractionated by distilling, if necessary, to separate the fraction having the required flash point and viscosity and finally, the oligomer is hydrogenated. We have found that oil produced has a smaller swelling effect on elastomers than do hydrogenated polypropylenes obtained by other processes.

Although the oil prepared by means of the present process, from propylene, isobutylene or n-butenes, are most useful as hydraulic fluids and have a small swelling effect on most elastomers, and certain elastomers undergo slight shrinkage in contact with this oil. Generally isoparaffinic oil has a greater swelling power the higher its content of impurities of the cyclane type. We have surprisingly discovered that a purely isoparaffinic oil brings about an appreciable contraction of certain elastomers, in particular elastomers based on polyurethanes which may be detrimental to the tightness of the joints of hydraulic circuits and that this may be overcome by blending in certain polycyclane oils.

Thus the present invention makes it possible to prepare an oil for hydraulic fluids which has a predetermined swelling power, also provides the incorporation with the oil produced by the process of the invention of a smaller proportion of a naphthenic oil may be adjusted to confer on the final oil the desired swelling power with the particular elastomer with which it is to be used.

The naphthenic oil used in these blends is preferably a mineral or synthetic oil consisting essentially of saturated hydrocarbons whose molecule comprises several condensed cycles, i.e. rings. It is possible to use in the present process any naphthenic oil provided that its flash point is sufficiently high and that it is practically free from aromatic hydrocarbons. An oil containing a high proportion of aromatic hydrocarbons would affect the mechanical properties of the elastomers. The presence of isoparaffinic hydrocarbons in this oil does not entail any drawbacks. The viscosity of the naphthenic oil matters little, provided that the final oil in which it is incorporated, has the desired viscosity, we prefer to use a naphthenic oil whose viscosity is between 10 and 100 cSt at 37.8° C.

It is possible to use a naphthenic oil derived from an appropriate crude petroleum, by means of the usual operations of distilling and refining. Nevertheless, it is very difficult in practice to obtain from petroleum a naphthenic oil sufficiently free from aromatic hydrocarbons. For this reason, a synthetic oil is used for preference. We prefer to use a synthetic oil consisting of cyclanic hydrocarbons whose molecule contains at least three condensed cycles, each with 5 carbon atoms. This type of oil may conveniently be prepared from a fraction of steamcracking naphtha distilling between 80° and 175° C. A fraction of naphtha of this kind contains high proportions of cyclopentadiene, dicyclopentadiene and mono or dimethyl derivatives of these cyclodienes. The cyclodienes present in the naphtha may be condensed to polycyclopentadienes by for instance maintaining the naphtha at about 260° C, at a pressure of 12 to 15 bars, for 2 to 4 hours. The product of this reaction may then be hydrogenated after diluting it with an inert solvent to yield the napththenic oil. Hydrogenation is performed by any usual means so as to saturate the ethylene bond of the molecules of polycyclopentadienes, to form the corresponding polycyclane hydrocarbons. The hydrogenated mixture is finally fractionated by distilling, so as to recover the solvent and separate a fraction having the desired flash-point and viscosity.

The proportion of naphthenic hydrocarbons incorporated with the oil made according to the present invention of our invention may be varied to adjust very accurately the swelling power of the final blend and as much as 20% napthenic oil may be used. We have found that the oil manufactured according to the invention from propylene and containing from 3 to 10%, or better still, from 5 to 8% of its weight of this type of naphthenic oil behaves absolutely satisfactorily in contact with the usual elastomers.

The polycyclane hydrocarbons may be incorporated with the final oil by simple mixing.

Alternatively the appropriate fraction of the oligomer obtained by our process may be mixed with the appropriate proportion of polycyclopentadienes, and hydrogenation the mixture.

The present invention also provides oil obtained by the process described above. It also provides hydrocarbon-based hydraulic fluid containing a high proportion of such oils and such a hydraulic fluid consisting of a basic oil and appropriate additives.

The oil may contain other conventional additives such as viscosity index improvers, extreme-pressure additives, anti-wear additives and oxidation inhibitors.

The present invention is illustrated but in no way limited by reference to the following examples.

EXAMPLE 1

A basic oil for hydraulic fluids having a viscosity between 16 and 18 cSt at 37.8° C was prepared as follows:

Propylene was brought into contact with 0.05% by weight of water and 0.06% by weight of anhydrous boron trifluoride in a stirred and cooled reactor at a pressure of 20 bars, and a temperature of 30° C. The mixture was in the reactor for half an hour. On leaving the reactor, the mixture was expanded from 20 to 1 bar pressures which brought about the evaporation of propane and boron trifluoride, which were thus eliminated. The remaining liquid was washed with dilute soda solution and an oligomer obtained having the following characteristics:

| Distillation (according to the standard ASTM D-86) | |
|---|---|
| Volume distilled (%) | Temperature° C |
| Initial point | 276 |
| 10 | 300 |
| 50 | 328 |
| 90 | 359 |
| Final point | 361 |
| Viscosity at 37.8° C | 15 cSt |
| Mean molecular mass | 340 |
| Bromine number | 44 |

This oligomer was hydrogenated on a catalyst based on nickel and cobalt, at 215° C under a hydrogen flow at a pressure of 18 bars and a speed of 0.25 $h^{-1}$.

A basic oil for hydraulic fluids was obtained by hydrogenation having the following characteristics:

| | |
|---|---|
| Viscosity at 37.8° C | 16.56 cSt |
| Viscosity at 99° C | 3.20 cSt |
| Viscosity index | 42 |
| Flash point, open vessel (Cleveland) | 144° C |
| Density at 15° C | 0.819 |
| Freezing point | −51° C |
| Bromine number | 0.4 |
| Aromatics content | 0.3% by weight |

The yield of final product in relation to the weight of the propylene used exceeded 99%.

EXAMPLE 2

A basic oil for hydraulic fluids was prepared having a viscosity between 4 and 6 cSt at 37.8° C.

The oligomerisation of the propylene was carried out as in Example 1, with the reactor temperature at 70° C and the yield of oligomer in relation to the weight of the propylene used exceeded 99.5% and the characteristics of the oligomer were:

| | |
|---|---|
| Viscosity at 37.8° C | 5.5 cSt |
| Flash point in open vessel (Cleveland) | 95° C |
| Mean molecular mass | 265 |

This oligomer was fractionated by distilling so as to isolate the fraction having the desired viscosity and flash point. To do so, three fractions were separated, a first fraction (7% by volume), mid fraction (79% by volume) and a residue (14%) by volume.

The intermediate fraction (79% by volume) had the required characteristics, viz:

| | |
|---|---|
| Viscosity at 37.8° C | 4.8 cSt |
| Flash point in open vessel (Cleveland) | 110° C |
| Mean molecular mass | 260 |

This fraction was hydrogenated by operating as in Example 1 except that the temperature was 180° C.

The oil (A) was obtained with a yield of 79% by weight in relation to the weight of propylene used and had the following characteristics:

| | |
|---|---|
| Viscosity at 37.8° C | 4.9 cSt |

-continued

| | |
|---|---|
| Viscosity at 99° C | 1.5 cSt |
| Density at 15° C | 0.806 |
| Freezing point | −60° C |
| Cleveland flash point | 110° C |
| Bromine number | 0.2 |
| Aromatic hydrocarbons | 0.2% by weight |
| Distillation (ASTM method D-86): | |
| Volume distilled (%) | Temperatures (° C) |
| Initial point | 237 |
| 10 | 249 |
| 50 | 278 |
| 90 | 314 |
| Final point | 326 |

By way of comparison an oil of the same type was prepared by means of a process similar to that of French Pat. No. 1,357,634 (corresponding to U.S. Pat. No. 3,283,029) in which propylene was oligomerised 190° C in contact with phosphoric acid deposited on kieselguhr and the fraction distilling from 200° to 300° C was separated. In this process the yield was 5% by weight in relation to the weight of propylene used. By hydrogenating this fraction, an oil (B) was obtained which was distinguished from oil (A) by its content of cycloparaffins and its behaviour in relation to elastomers.

The composition of the two oils, determined by mass spectrometry, was as follows:

| | Oil A | Oil B |
|---|---|---|
| Isoparaffins | 99.7 | 88.1 |
| Cycloparaffins | 0.1 | 11.3 |
| Aromatics | 0.2 | 0.5 |

A sample of polyurethane rubber was immersed in each of these oils at 130° C, for 20 days. After this test, the volume of the sample immersed in oil A had dropped by 6.9%, and that of the sample immersed in oil B had risen by 3.8%.

EXAMPLE 3

Two oils were prepared having determined swelling powers, by mixing a naphthenic oil (C) with the oil A defined in Example 2.

Oil C was prepared by heating 170 kg of a fraction of naphtha obtained by steam cracking and distilling from 80° to 175° C which contained approximately 60% dimers of cyclopentadiene and methyl-cyclopentadiene in an autoclave, for up to 260° C and then held at that temperature for a further 2 hours. The contents ofthe autoclave are then reduced by distilling until obtaining 100 kg residue which was a resinous, very dark brown substance, whose bromine number was 60. It was treated with 500 kg of a hydrocarbon solvent distilling at 150° to 180° C and the solution obtained hydrogenated on a basic nickel and tungsten catalyst, at 240° C under 60 bars, until the bromine number of the product is zero. The product of hydrogenation was distilled to separate the solvent, 40 kg of an oil distilling from 280° to 380° C (oil C) and 60 kg residue.

Oil C was practically colourless and had the following characteristics:

| | |
|---|---|
| Density at 15° C | 1.019 |
| Refractive index | 1.529 |
| Viscosity at 37.8° C | 80.5 cSt |
| Viscosity at 99° C | 7.2 cSt |
| Bromine number | less than 1 |
| Flash point (Cleveland) | 142° C |
| Freezing point | −12° C |

Two mixtures were then prepared, one with 93% oil A and 7% oil C, the other with 86% oil A and 14% oil C. These proportions being by volume.

A sample of polyurethane rubber was immersed in oil A and in each mixture at 130° C for 20 days. The mechanical characteristics of the samples were measured before and after each very stringent test, and the variation of each characteristic was calculated in relative terms (% of initial value).

The following results were obtained:

| Oil tested | Oil A | 93% A 7% C | 86% A 14% C |
|---|---|---|---|
| Relative variation (%): | | | |
| of the module at 100% | −85 | −86 | −84 |
| of the module at 300% | −81 | −79 | −79 |
| of the breaking loan | −85 | −85 | −83 |
| of the volume | −6.90±0.5 | +2.2±0.5 | +2.7±0.5 |

We claim:

1. Process for manufacturing selectively, with a high yield, a highly paraffinic hydraulic transmission oil consisting essentially of isoparaffins and substantially free of cycloparaffins and aromatics, for use in hydraulic systems having elastomeric seals, said oil being compatible with said seals and tending to shrink said seals when of polyurethane rubber, and said oil having a flash point above 100° C. and a viscosity within the range from 2 to 30 Centistokes at 37.8° C., said process comprising:

oligomerising propylene, in the liquid phase, in the presence of a Friedel and Crafts catalyst, at a temperature between 20° C. and 80° C., separating the catalyst and propylene oligomer, and hydrogenating said oligomer or a fraction thereof to thereby obtain said oil.

2. A process according to claim 1 in which the catalyst comprises from 0.04 to 0.08% by weight of water and from 0.5% to 0.8% by weight of anhydrous boron trifluoride, based on the weight of propylene.

3. A process according to claim 1 in which the hydrogenation is continued until the bromine number is less than 1.

4. A process according to claim 1 in which hydrogenation is performed using a catalyst based on cobalt and nickel at a temperature from 180° C to 220° C at a pressure from 10 to 100 bars.

5. In a hydraulic system having elastomeric seals, a hydraulic oil composition comprising a major amount of paraffinic hydraulic transmission oil prepared by the process according to claim 1.

6. In a hydraulic system having elastomeric seals according to claim 5, said hydraulic oil composition comprising 80% to 99% by weight of said paraffinic oil and 20% to 1% by weight of a naphthenic oil substantially free from aromatic hydrocarbons and having a flash point greater than 100° C. and a viscosity between 10 and 100 centistokes at 37.8° C., said naphthenic oil imparting seal swelling ability to said hydraulic oil composition.

7. In a hydraulic system according to claim 6, said naphthenic oil having a viscosity between 10 and 100 centistokes at 37.8° C. and consisting essentially of cyclanic hydrocarbons containing at least three condensed rings of 5 carbon atoms per ring.

8. In a hydraulic system according to claim 6, said composition containing from 3 to 10% by weight of said naphthenic oil and wherein said elastomeric seals are of polyurethane rubber.

9. In a hydraulic system according to claim 6, said composition containing from 5 to 8% by weight of the naphthenic oil.

* * * * *